US006979064B2

(12) United States Patent
Chiu

(10) Patent No.: US 6,979,064 B2
(45) Date of Patent: Dec. 27, 2005

(54) DRAWER INTERLOCK MECHANISM

(75) Inventor: I-Hsiang Chiu, Taipei (TW)

(73) Assignee: Nan Juen International Co., Ltd., Taipei (TW)

( * ) Notice: Subject to any disclaimer, the term of this patent is extended or adjusted under 35 U.S.C. 154(b) by 68 days.

(21) Appl. No.: 10/706,958

(22) Filed: Nov. 14, 2003

(65) Prior Publication Data

US 2005/0104485 A1 May 19, 2005

(51) Int. Cl.[7] ..... E05C 7/06
(52) U.S. Cl. ..... 312/221; 312/217
(58) Field of Search ..... 312/217, 218, 312/219, 220, 221, 222

(56) References Cited

U.S. PATENT DOCUMENTS 4,889,396 A * 12/1989 Mitchell et al. ..... 312/221
4,966,423 A * 10/1990 Higuera et al. ..... 312/221
5,176,436 A * 1/1993 Mitchell ..... 312/221
5,352,030 A * 10/1994 Derle et al. ..... 312/221
6,238,024 B1 * 5/2001 Sawatzky ..... 312/221
6,254,205 B1 * 7/2001 Wright et al. ..... 312/217
6,568,771 B2 * 5/2003 Gentili et al. ..... 312/221
6,637,843 B2 * 10/2003 Westwinkel ..... 312/221

FOREIGN PATENT DOCUMENTS

DE 4004724 * 5/1991 ..... 312/218
GB 2170993 * 8/1986 ..... 312/221

* cited by examiner

*Primary Examiner*—Lanna Mai
*Assistant Examiner*—Hanh V. Tran
(74) *Attorney, Agent, or Firm*—Troxell Law Office, PLLC

(57) ABSTRACT

A drawer interlock mechanism comprises a fixation base, an axial cam, two braking slides and a guiding switch. The axial cam is put into a holding groove of the fixation base, so a big column and a small column are respectively placed into the position-limiting groove on top surface of the holding groove. The two braking slides are put in a slide groove of the fixation base, so when the axial cam rotates 90 degrees, its moving and stopping blocks move the two braking slides outward. The guiding switch is locked with the slide at the front. Its side has a guiding groove and a curved groove, which correspondingly match the big column and the small column, so they move according to the path lead by the curved slide groove and the guiding slide groove and the axial cam can rotate 90 degrees.

6 Claims, 12 Drawing Sheets

DRAWER INTERLOCK MECHANISM

FIELD OF THE INVENTION

The present invention is related to a drawer interlock mechanism. Especially, it has a simplified design for positioning axial cam and facilitating the assembly of connecting components.

BACKGROUND OF THE INVENTION

Presently, for multiple drawers lined up vertically to effectively prevent simultaneous opening of the drawer above or underneath, an interlock mechanism is implemented.

As shown in FIG. 1, a traditional drawer interlock mechanism 1 is implemented for multiple drawers lined up vertically. FIG. 2 shows the traditional drawer interlock mechanism 1', mainly composed of a fixation base 11', an axial cam 12', two braking slides 13' and a switch 21' of a slide 2'. The axial cam 12' uses an axle 121' to place in an axial hole 111' of the fixation base 11', so when a top convex 122' is being moved by the switch 21' of the slide 2' and locking into or taking off the top guiding groove 22', the axial cam can make 90-degree rotation.

However, as shown in FIG. 3 and FIG. 4, the above-mentioned axial cam 12' has a steel ball 125' that is in the bottom groove hole 123' and subject to regular push by a spring 124'. It also has a bottom convex point 126' on the other side of the bottom. On the sticking plate at the front end of the rail 3', there are two grooves 31' separated by 90 degrees, a guiding groove 32 and a penetrating hole 33'. The bottom convex 126' corresponds to the guiding groove 32' in the rail 3' and serves to limit the position of the axial cam 12' in rotation. The steel ball 125' is subject to regular push against the sticking plate at the front end of the rail 3", so when the axial cam 12' is rotating, it can be positioned in the two groove 31' for making 90-degree rotation. Thus, such a way to achieve positioning of the axial cam 12' in 90-degree rotation involves many components and complicated design. Furthermore, such design needs riveting to place the axis 121' in the penetrating hole 33' on the sticking plate at the front end of the rail 3' as shown in FIG. 4. This causes a tedious process of assembly and relatively high manufacturing cost, which lowers the product competitiveness.

Please refer to FIG. 2 and FIG. 5. The above-mentioned braking slides 13' are inserted into the slide groove holes 112' of the fixation base 111' and fit each other to be against the axial cam 12'. When the axial cam 12' is making 90-degree rotation, it moves the two braking slides 13' outward and drives the braking rod 4' on the axial cam 12' to activate with the locking mechanism for the top or bottom drawer. Because the braking slide 13' has one sticking positioning component 131' on one side that needs special orientation for assembly, it causes inconvenience. Furthermore, when the drawer interlock mechanism 1' is integrated with the slide 2' and the rail 3' to form a single unit configuration, the entire unit is placed on the drawer and the two braking slides 13' do not provide effective blockage. As a result, the braking slide 13' underneath falls off the fixation base 11'. It requires separate assembly for the braking slide 13' and takes much labor.

SUMMARY OF THE INVENTION

The present invention aims to improve the deficiency of the above-mentioned traditional drawer interlock mechanism based on user's demands, so the design for the positioning mechanism of axial cam is simplified. Furthermore, the assembly will be facilitated by the new connection components to effectively reduce manufacturing cost and assembly time. As a result, the product competitiveness will be significantly improved and benefit the industry.

DETAILED DESCRIPTION OF THE INVENTION

Figure 1:
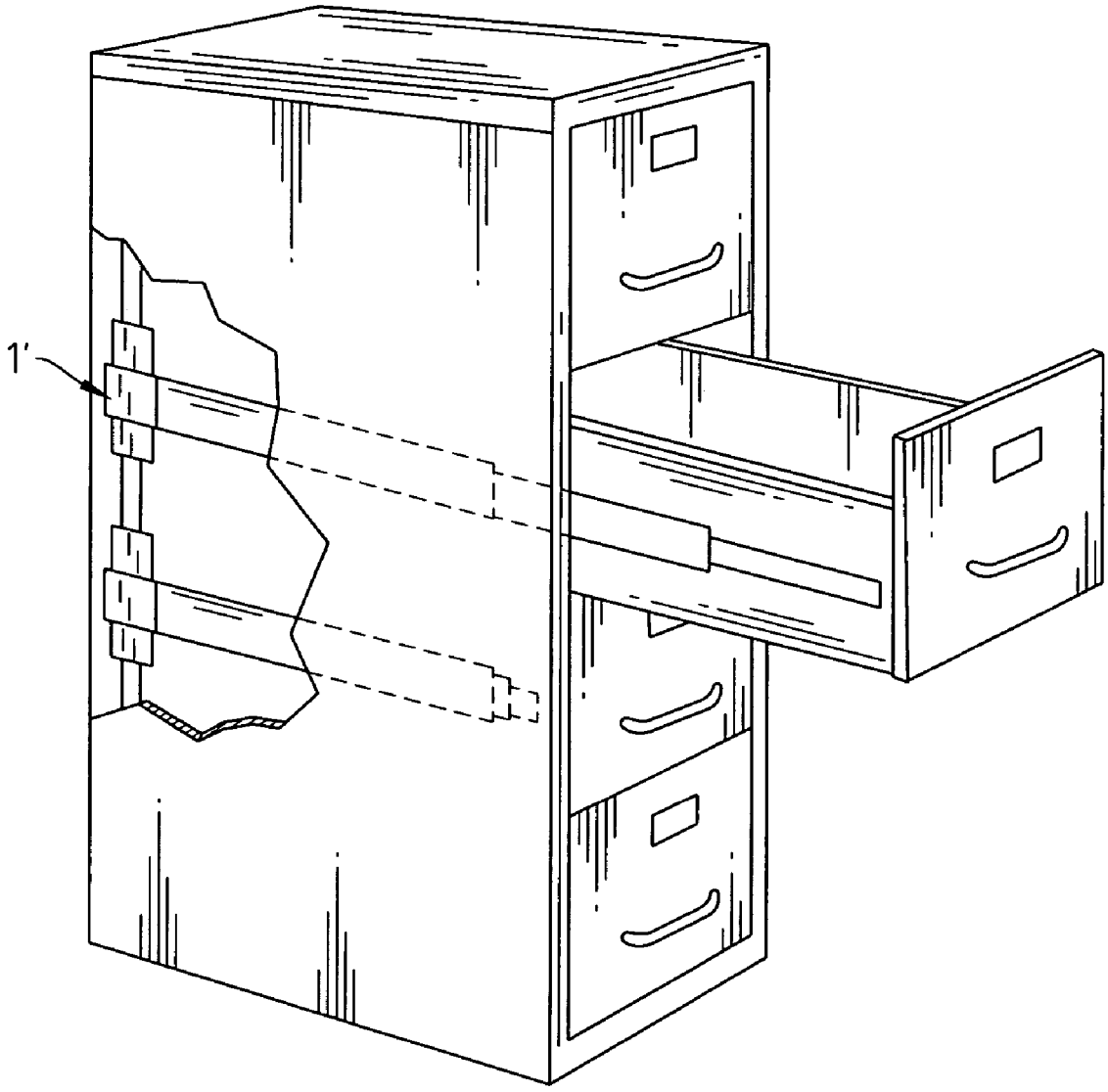
Fig. 1 Prior Art
FIG. 1 is an example of embodiment of a traditional drawer interlock mechanism.
Figure 2:
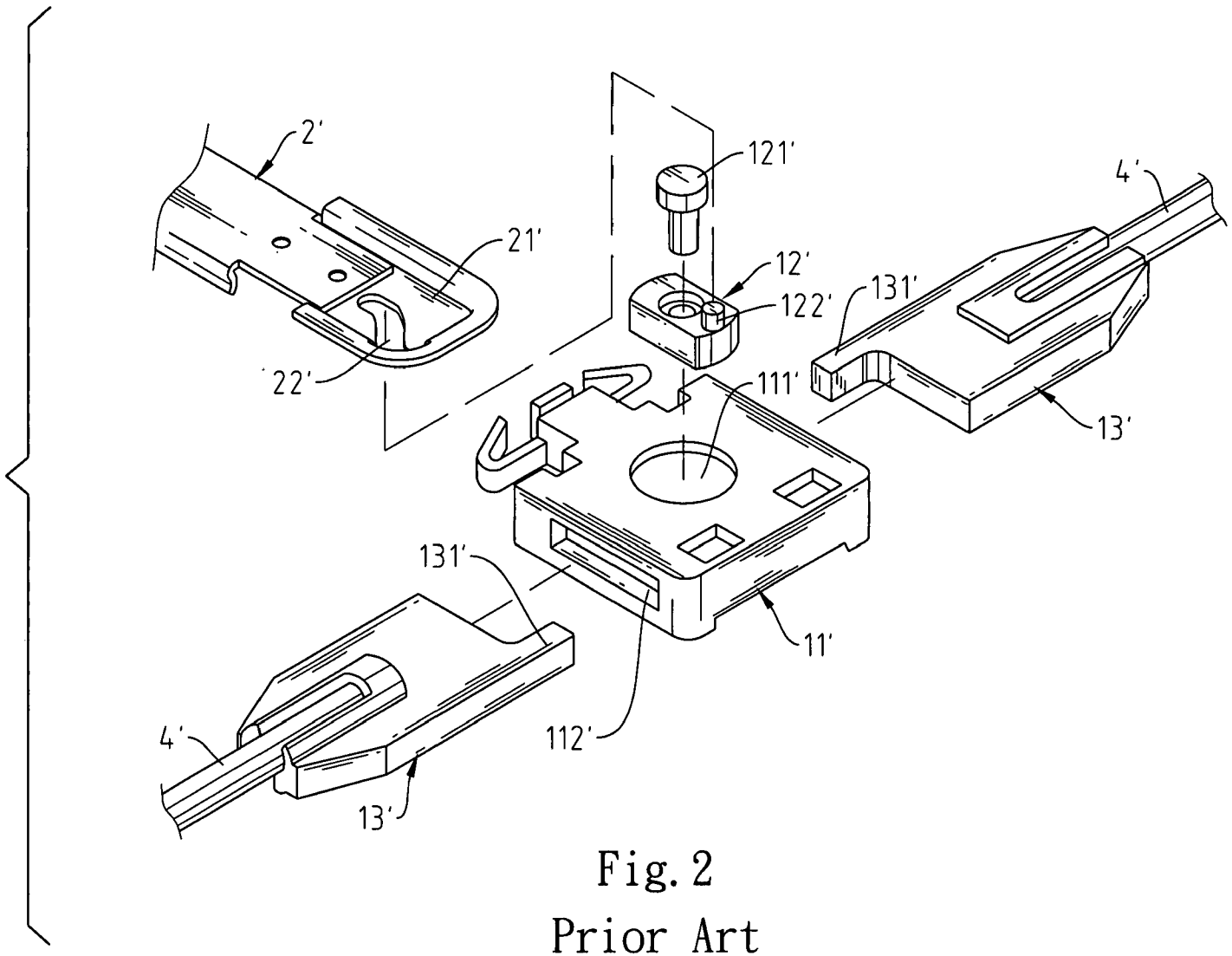
Fig. 2 Prior Art
FIG. 2 is an illustration of the configuration for a traditional drawer interlock mechanism.
Figure 3:
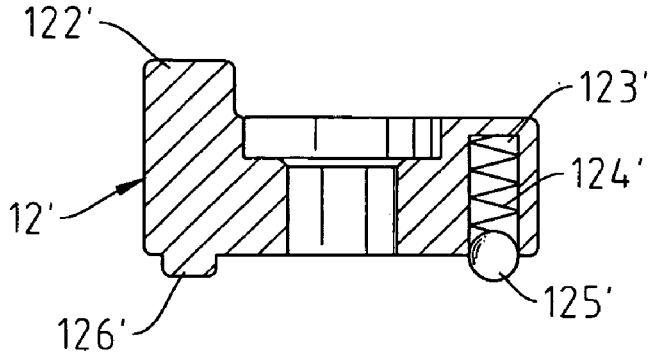
Fig. 3 Prior Art
FIG. 3 is an illustration of the cross-section of the axial cam for a traditional drawer interlock mechanism.
Figure 4:
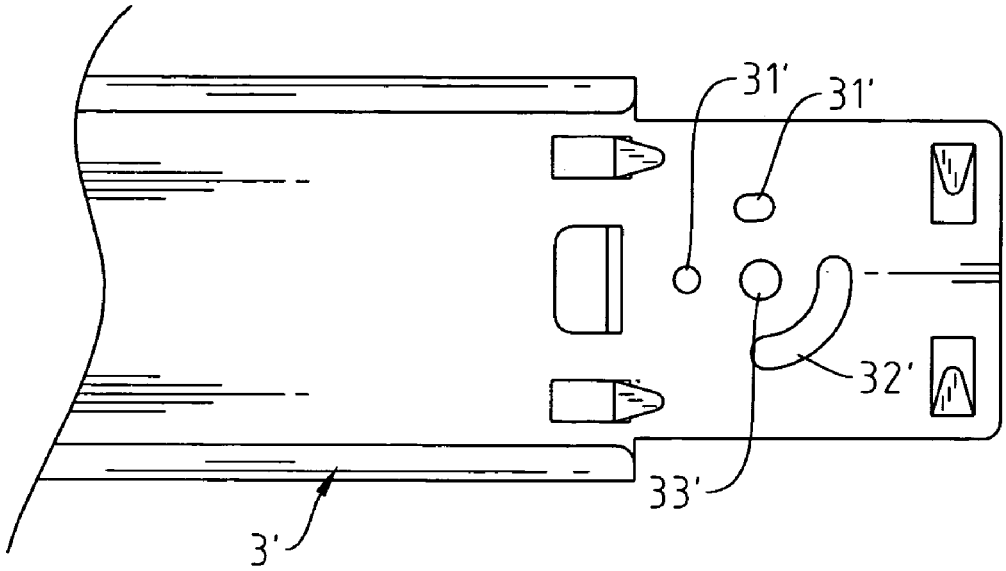
Fig. 4 Prior Art
FIG. 4 is an illustration for the configuration that shows positioning groove holes on the front sticking plate in a traditional drawer interlock mechanism.
Figure 5:
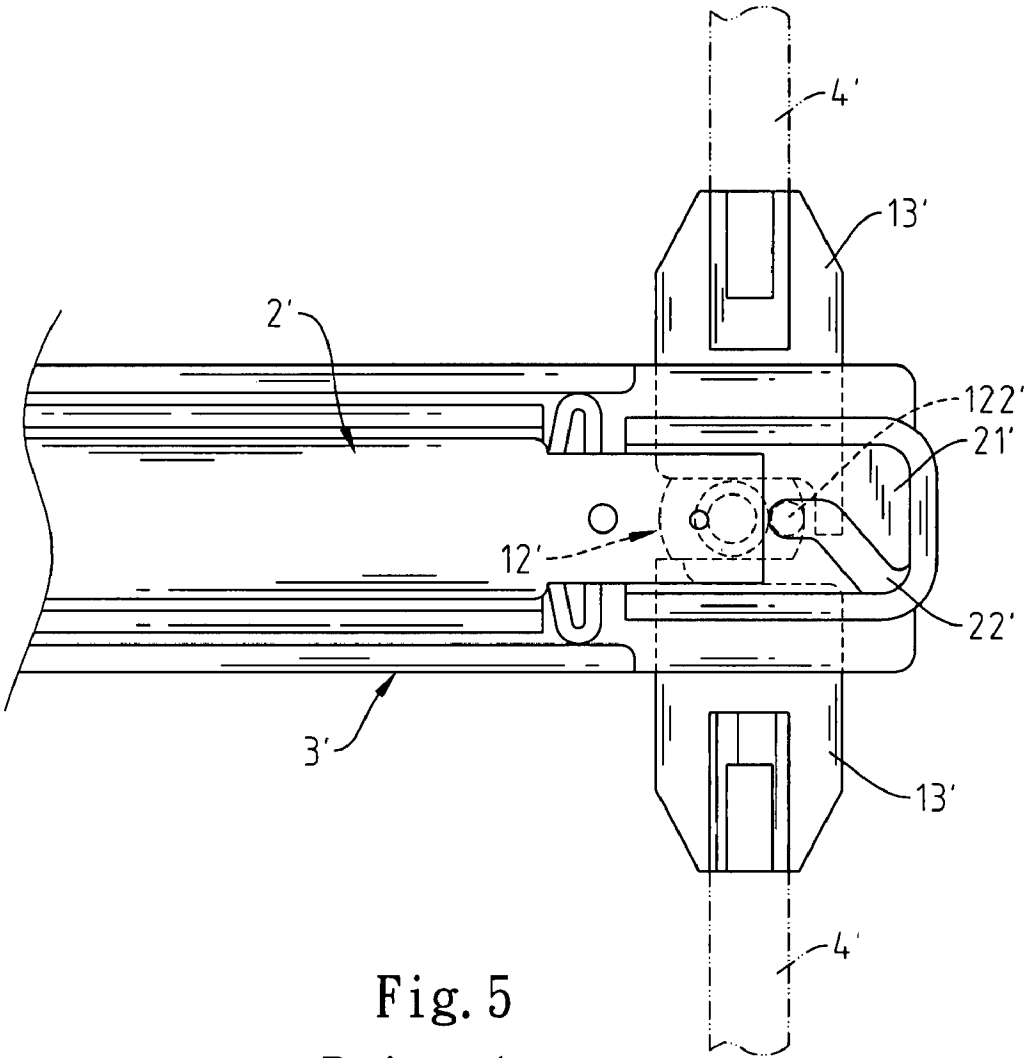
Fig. 5 Prior Art
FIG. 5 is an example of embodiment of the configuration for a traditional drawer interlock mechanism.

Please refer to the figures from FIG. 6 to FIG. 15. The drawer interlock mechanism in the present invention mainly comprises a fixation base 1, an axial cam 2, two braking slides 3 and a guiding switch 4.

The fixation base 1 is fixed at one end of the rail 6. In the center of the fixation base 1, there is the holding groove 11, which has concave openings 111 every 90-degree angle along the inner periphery. There is a penetrating hole 112 in the center of top face along with two corresponding position-limiting curved grooves 113. At the bottom of the fixation base 1, there is a slide groove 12 in longitudinal direction. On the each side of the slide grooves 12, there is a convex point 121. The two convex points 121 face each other in a decline angle. The rail 6 also has correspondent groove holes 61 to the slide grooves 12. The fixation base 1 has a sticking block 13 on each side of the top face in the longitudinal direction.

The axial cam 2 has an expandable tenon 21 extending along the outer edge of each side. On the two outer edges formed in the direction of 90-degree intersecting lines from the axial cam 2 and the expandable tenon 21, there are a big column 22 and a small column 23. In the middle of the big column 22 and the small column 23, there is a rotation axis 24. A moving and stopping block 25 is situated at the bottom of the axial cam 2. The top face of the axial cam 2 is inserted into the holding groove 11 of the fixation base 1. The rotation axis 24 is placed in the axis hole 112. The big column 22 and the small column 23 are inserted into the position-limiting groove 113 respectively. The expandable tenon 21 can be correspondingly inserted into the concave opening 111, so the axial cam 2 can rotate on the fixation base 1. The big column 22 and the small column 23 inserted to the position-limiting curved groove 113 are subject to path restriction. So the axial cam 2 set onto the fixation base 1 can only make 90-degree rotation. For every 90-degree rotation, the expandable tenon 21 sets into the correspondent concave opening 111, so the axial cam 2 is subject to positioning after 90-degree rotation.

When we compare the axial cam 2 in the present invention to the traditional axial cam 12', its positioning after 90-degree rotation does not rely on the axis 121', the spring 124', the steel ball 125' and bottom convex point 126', but only on the expandable tenon 21 on the periphery of the axial cam 2, and the locking and positioning by the sticking big column 22, the small column 23 and the fixation base 1. In this way, the design of the locking mechanism of rotating cam is simplified.

The two braking slides 3 are inserted into the slide groove 12 of the fixation base 1. Its external holding groove 31 can hold a braking stick for movement. On each of the two sides of the two braking slides 3, there is an extending blockage 32, so the two braking slides 3 connect to form a rectangular frame (as shown in FIG. 8) to accommodate the stopping block 25 of the axial cam 2.

Furthermore, the two braking slides 3 have two correspondent guiding groove 33 on both sides of the plate, so no matter the front or back face of the braking slide 3 is inserted in the slide groove 12, the guiding groove 33 can fit the convex point 121 on the slide groove 12. On the groove surface at the introduction end of the guiding groove 33, there is a locking point 331 to stop the convex point 121. Thus, when the two braking slides 3 are sliding outward, they are subject to position limitation by the blockage of the locking point 331 and the convex point 121 of the slide groove 12. So the two braking slides 3 through the correspondent groove holes 61 on the two sides of the rail 6 are forced to lock into the slide grooves 12 of the fixation base 1. Through the locking mechanism of the locking point 331 and the convex point 121 of the slide groove 12, they do not fall off the slide groove 12 and the rail 6. The entire mechanism is set on the slide 5 and the rail 6 to form a unit configuration, which can be assembled with the drawer. Thus, the two braking slides 3 do not need a separate assembly procedure and simplify and facilitate the assembly process.

Figure 8:
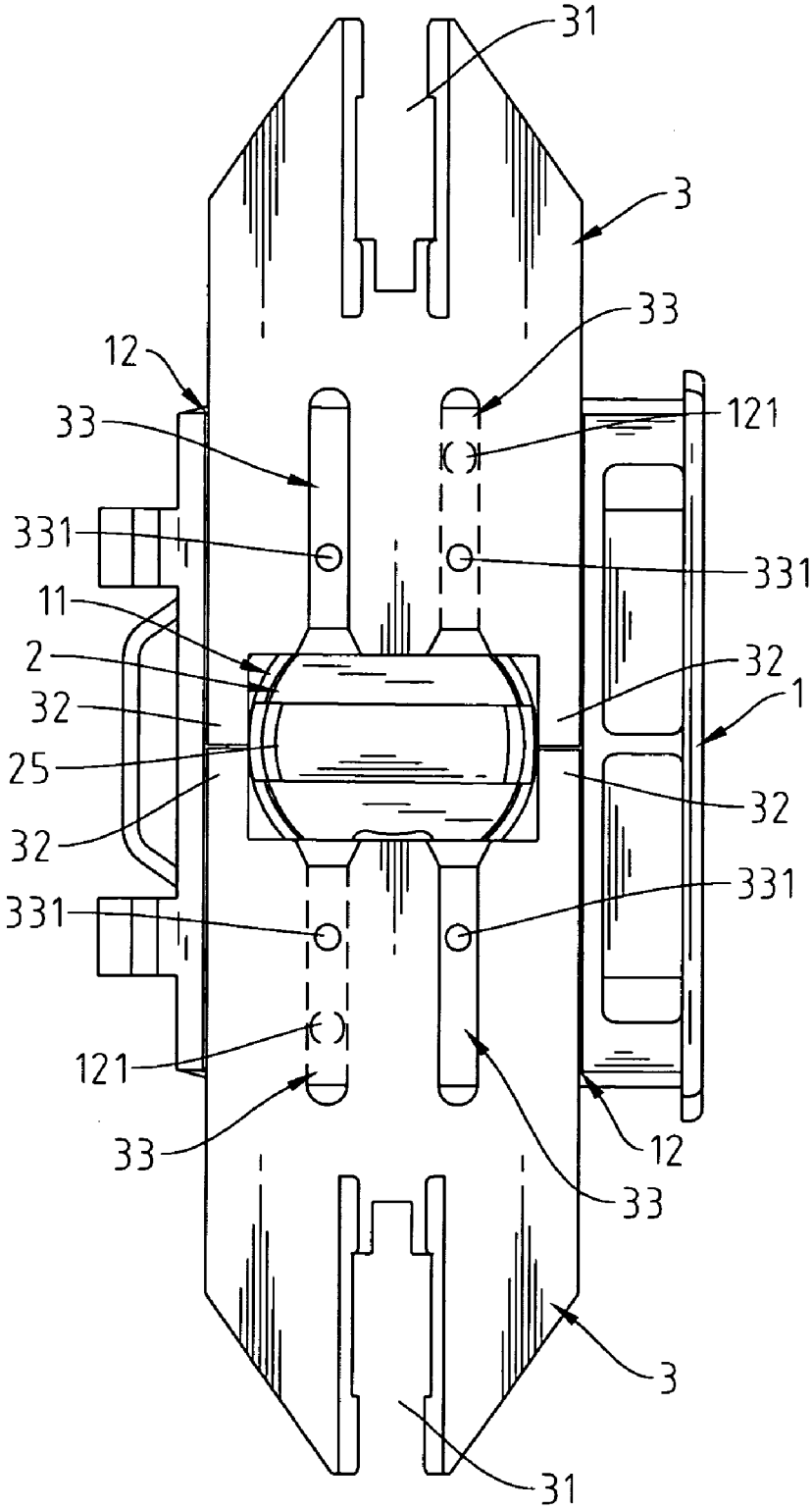
FIG. 8 is an illustration of the two braking slides that are not moved by the moving and stopping blocks in the present invention.
Figure 9:
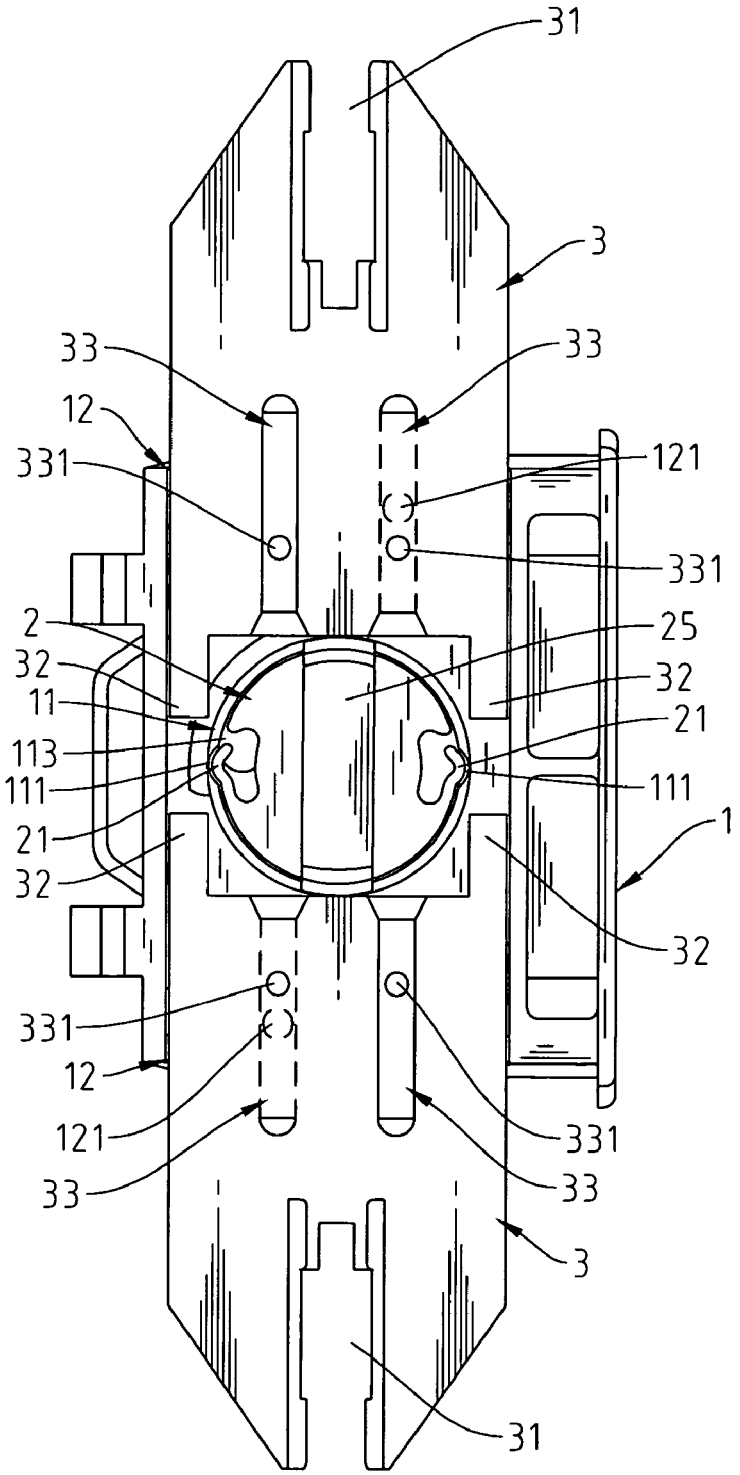
FIG. 9 is an illustration of the two braking slides that are moved by the moving and stopping blocks in the present invention.

As shown in FIG. 8 and FIG. 9, when the axial cam 2 rotates 90 degrees and is positioned, the stopping block 25 can move the two matching braking slides 3 outward, so the braking stick in the groove 31 can assure the closure of the top or bottom drawer. In this way, when one drawer is opened, it prevents the opening of the top or bottom drawer and provides an interlock protection.

Therefore, the two braking slides 32 adopt the design of symmetric blockage 32, so any of the braking slides 3 can be placed into any slide groove 12 of the fixation base 11. It does not need to identify the insertion direction and simplifies assembly process. It also offers convenience in practical application.

Figure 6:
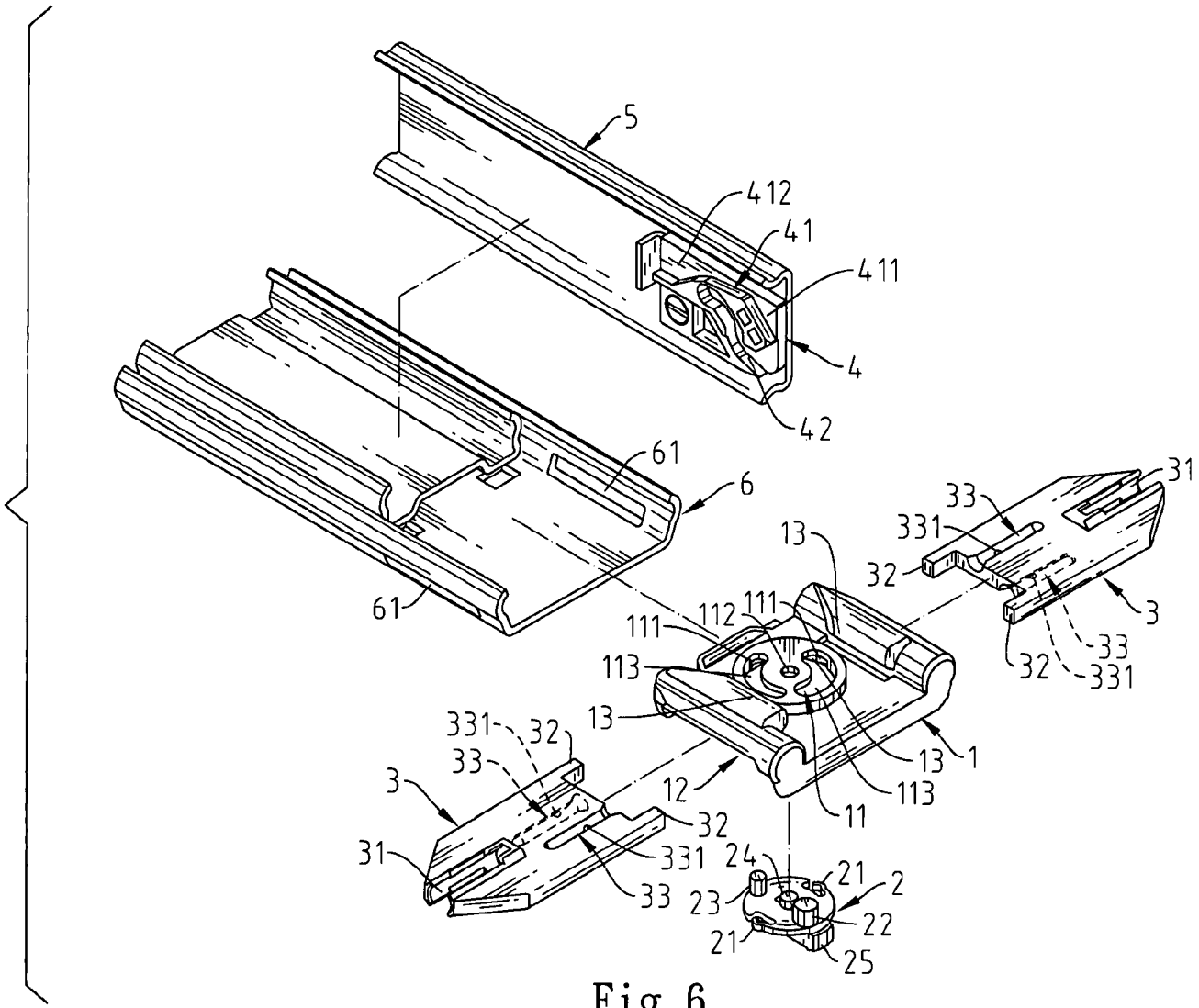
FIG. 6 is an illustration of the configuration for the drawer interlock mechanism in the present invention.
Figure 7:
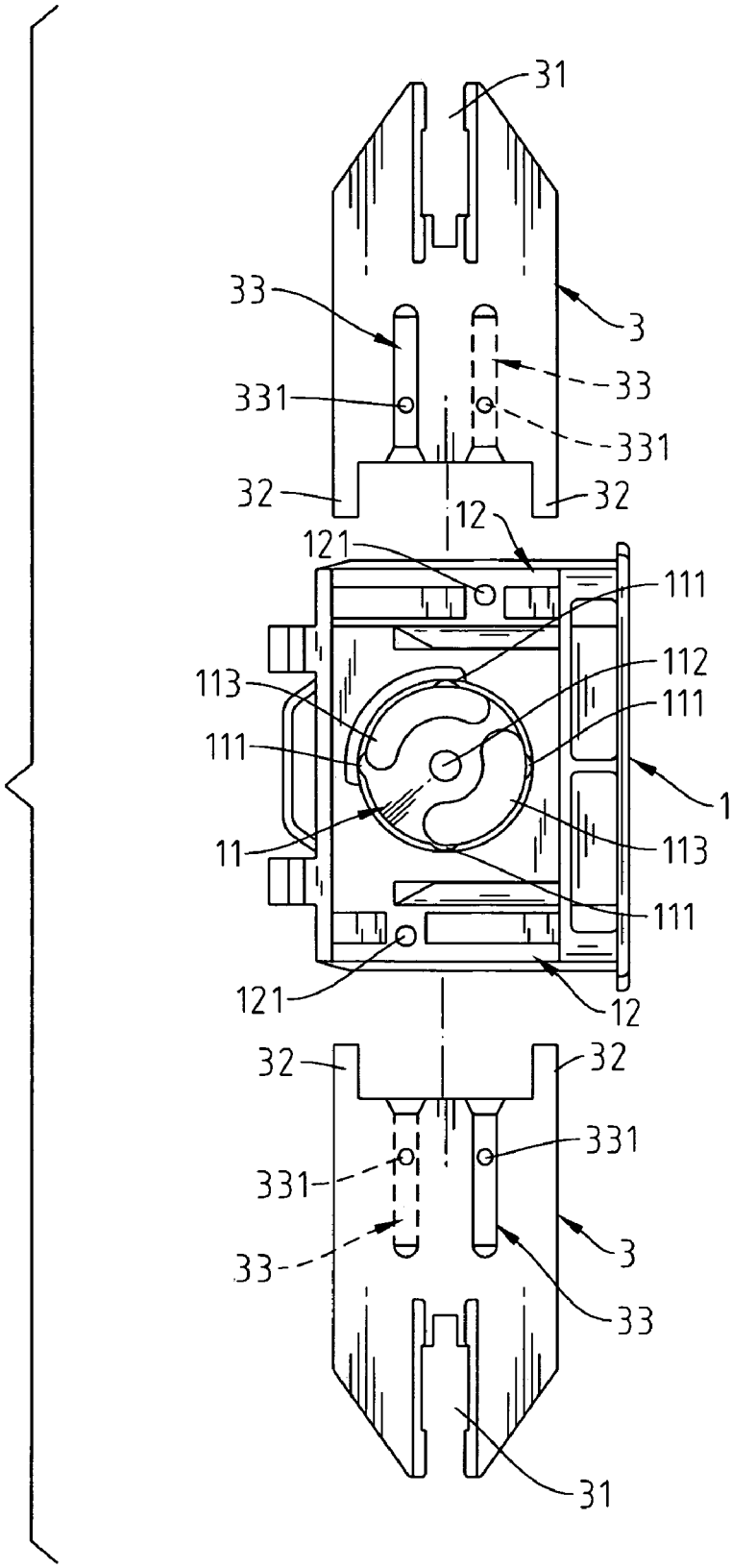
FIG. 7 is an illustration of the two braking slides installed on the fixation base for the present invention.
Figure 10:
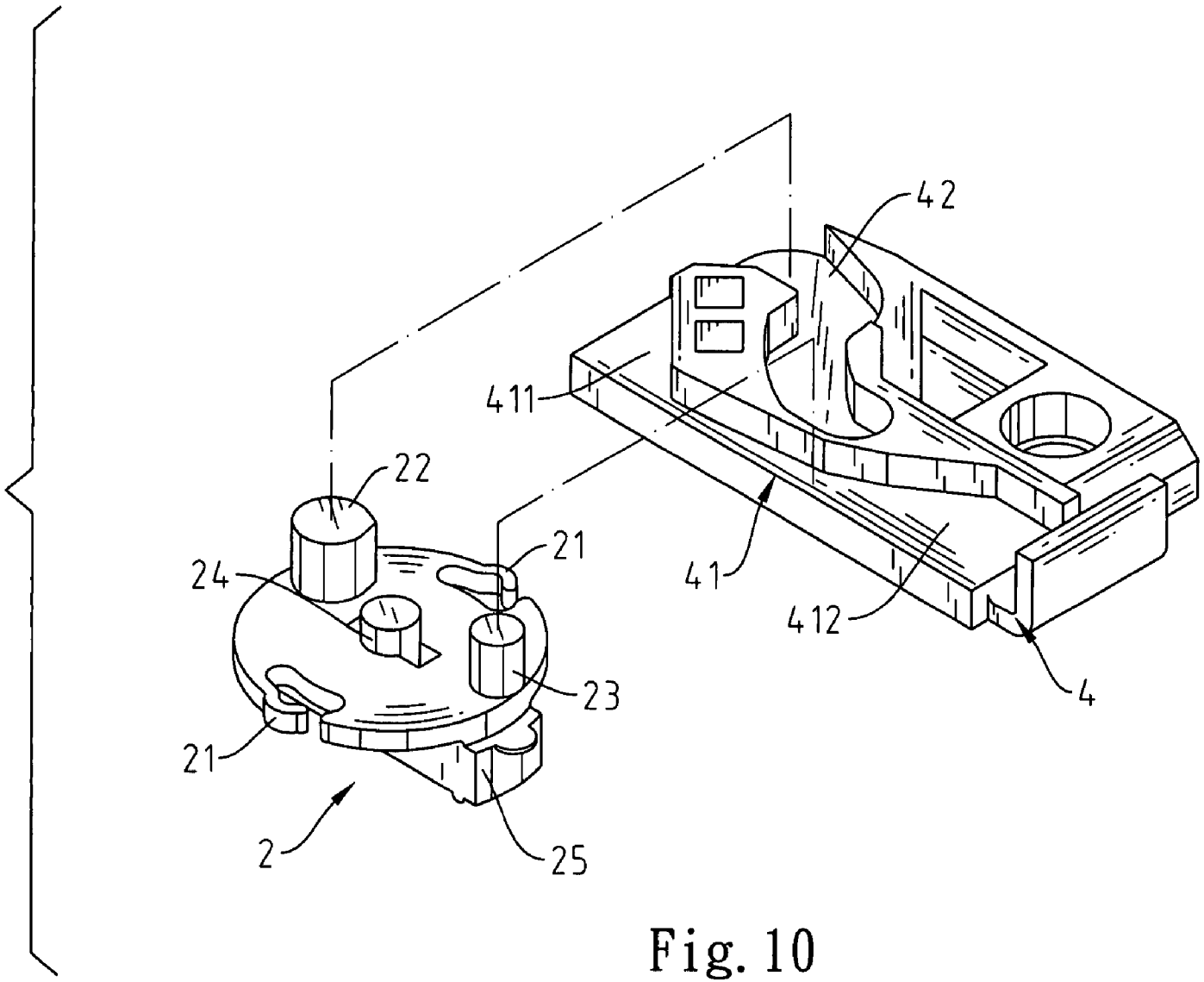
FIG. 10 is an illustration of the assembly of the guiding switch and the axial cam in the present invention.
Figure 11:
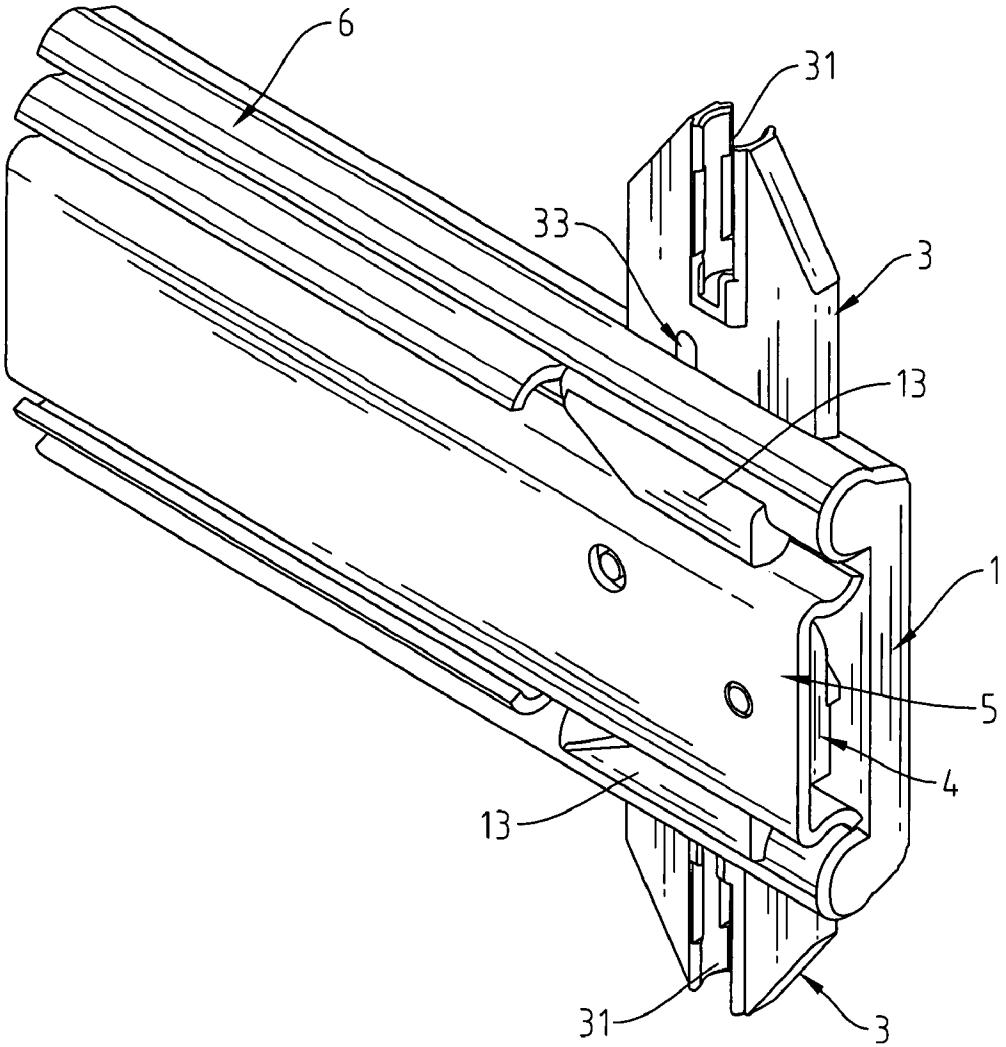
FIG. 11 is an illustration of the assembly of the sliding components and the slide rail in the drawer interlock mechanism for the present invention.

Please refer to FIG. 6. The guiding switch 4 is set to the front end of the slide 5. The side has a guiding slide groove 41 and a curved slide groove 42. The guiding slide groove 41 has a front guiding groove 411 and a rear guiding groove 412. When the slide 5 is moving toward the fixation base 1, the guiding slide groove 41 for the guiding switch 4 can fit the small column 23 of the axial cam 2, while the curved slide groove 42 can fit the big column 22 of the axial cam 2 (as shown in FIG. 10).

Figure 12:
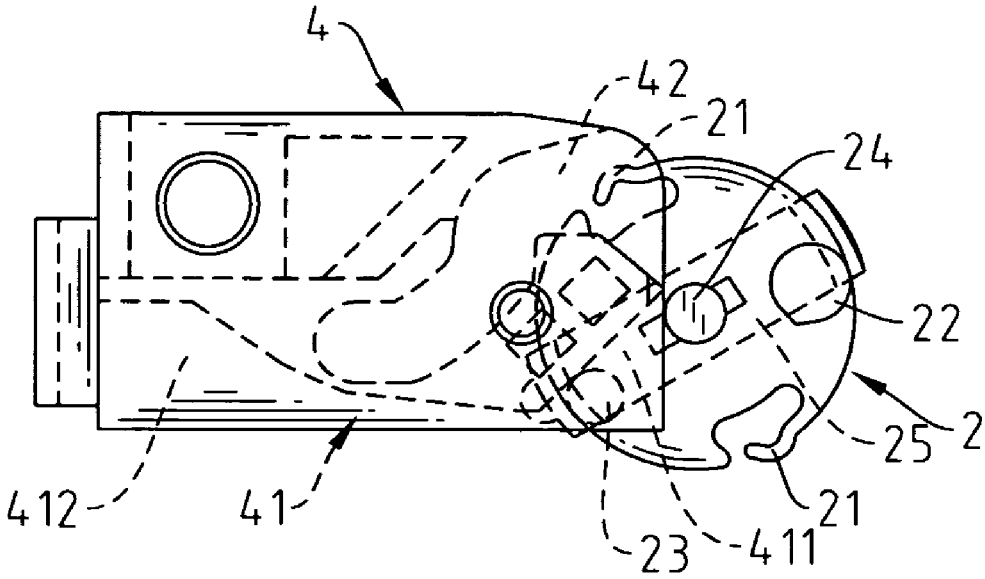
FIG. 12 is the first illustration of the status that the guiding switch advances to rotate the axial cam in the present invention.
Figure 13:
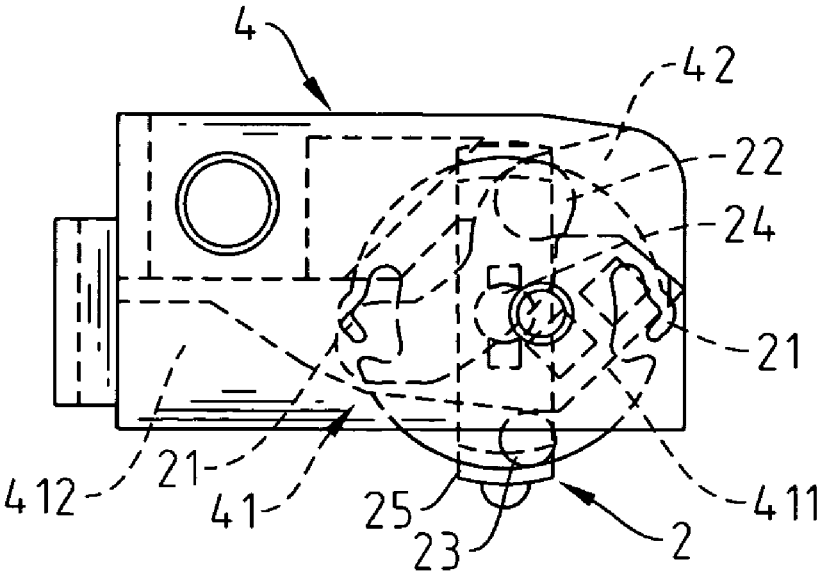
FIG. 13 is the second illustration of the status that the guiding switch advances to rotate the axial cam in the present invention.

As shown in the embodiments from FIG. 11 to FIG. 15, when the slide 5 is moving forward and is placed in the bottom edge of the block 13 of the fixation base 1, if the stopping block 25 of the axial cam 2 under external influence remains in an unusual position as shown in FIG. 12, the small column 23 of the axial cam 2 in the present invention is moved by the front guiding groove 411 of the guiding switch 4, which makes the axial cam 2 in a rotation state as shown in FIG. 13. The big column 22 can be introduced into the entrance of the curved slide groove 42. Thus, the stopping block 25 of the axial cam 2 still moves the two braking slides 3 forward and makes the top or bottom drawer in a closure status in a vertical layout. Therefore, the drawer interlock mechanism of the present invention has a design of fault prevention measure to assure the repositioning of the axial cam 2. So even under improper use, the stopping block 25 of the axial cam 2 can be recovered to original state and move the two braking slides 3 outward. So the top or bottom drawer is in closure state as shown in FIG. 9, which is subject to unlocking process for the top or bottom drawer.

Figure 14:
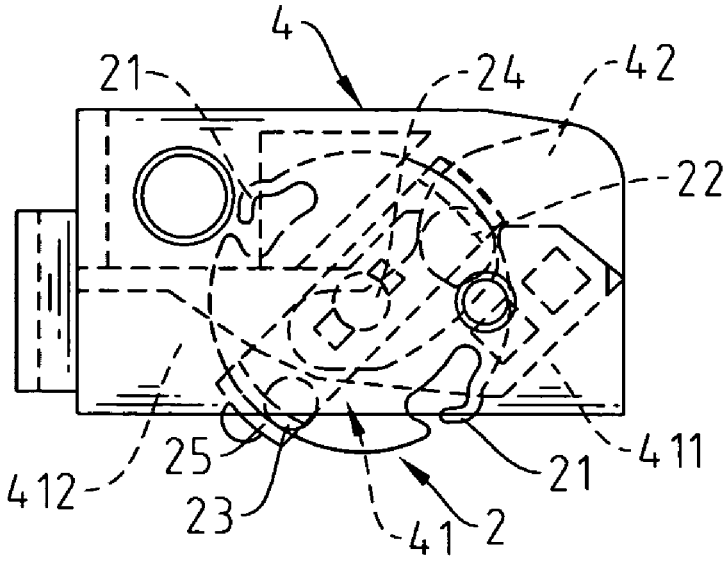
FIG. 14 is the third illustration of the status that the guiding switch advances to rotate the axial cam in the present invention.
Figure 15:
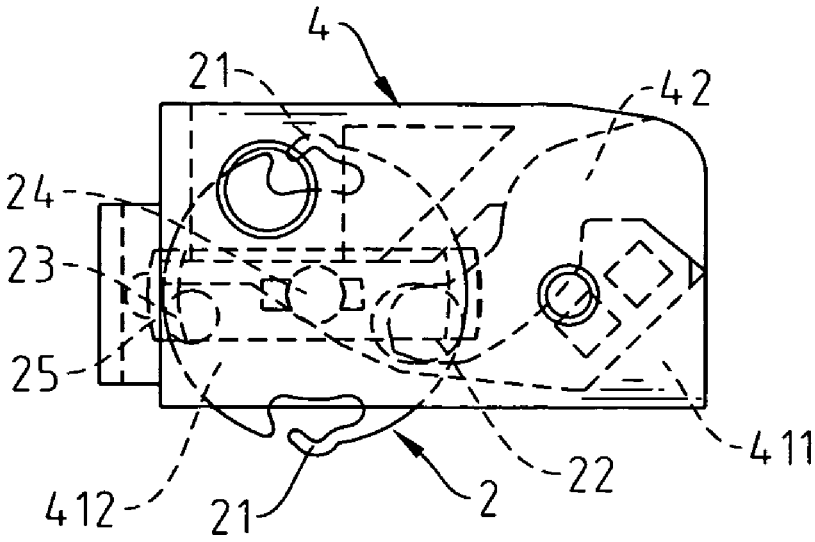
FIG. 15 is the forth illustration of the status that the guiding switch advances to rotate the axial cam in the present invention.

When the slide 5 continues to move forward, it makes the big column 22 in the curved slide groove 42 subject to push as shown in FIG. 14. Through the guiding of the curved path of the curved slide groove 42, the small uses the rear guiding groove 412 of the guiding slide groove 41 to continue the rotation of the stopping block 25 of the axial cam 2, which is a 90-degree rotation as shown in FIG. 15. This makes the two braking slides 3 against each other inward (as shown in FIG. 8) and prevents the top or bottom drawer from a closure state.

On the contrary, when the guiding switch 4 is moving backward and takes off, the big column 22 of the axial cam 2 uses the curved slide groove 42 in the same way for guiding. The small column 23 uses the rear guiding groove 412 of the guiding groove 41 for guiding. So the stopping block 25 of the axial cam 2 rotates in sequence as shown in figures from FIG. 13 to FIG. 15 and provides a positioning effect after 90-degree rotation. As a result, the two braking slides 3 again are subject to the push by the moving and stopping block 26 to move outward (as shown in FIG. 9). The top or bottom drawer remains in a closure state and can not be open.

To sum up, the drawer interlock mechanism in the present invention can achieve an interlock effect for the top or bottom drawer in closure or opening state. Besides, the design of the axial cam positioning mechanism is simplified. The connection components can facilitate assembly and effectively lower the manufacturing cost and significantly increase product competitiveness. It has a great value for practical application.

What is claimed is:

1. A drawer interlock mechanism comprising:

a) a fixation base fixed to one end of a rail and having a holding groove located in a center thereof and two sticking blocks, the holding groove having:

i) a plurality of concave openings spaced apart 90-degrees and located on an outer periphery thereof;

ii) a penetrating hole located in a center of a top face thereof;

iii) two corresponding position-limiting curved-grooves located around the penetrating hole; and iv) a slide groove located on a bottom of the fixation base in a longitudinal direction, one of the two sticking blocks is located on each of two opposing sides of the top face thereof in the longitudinal direction;

b) an axial cam having:

i) two expandable tenons located on an outer periphery thereof, one of the two expandable tenons is located on each of two opposing sides of the axial cam;

ii) a big column and a small column located on opposing sides of the outer periphery of a top of the axial cam, each of the big column and the small column are spaced apart 90-degrees from the two expandable tenons;

iii) and a rotation axis located in a center of the top thereof; and iv) a moving and stopping block located on a bottom thereof, the top of the axial cam is inserted into the holding groove of the fixation base, the rotation axis is rotatable inserted into the penetrating hole c) two braking slides, each of the two braking slides having:

i) an external holding groove located on a first end thereof for holding a braking stick; and ii) two extending blockages located on opposing sides of a second end thereof, the second end of each of the two braking slides is inserted into the slide groove of the fixation base, the moving and stopping block of the axial cam is located between the two braking slides; and d) a guiding switch located on a front end of a slide and having a guiding slide groove and a curved slide groove, the guiding slide groove having a front guiding groove and a rear guiding groove, the guiding slide groove receiving the small column of the axial cam and the curved slide groove receiving the big column of the axial cam when the slide is moved toward the fixation base, the small column following the front guiding groove and driving the big column into the curved slide groove, when the big column moves along the curved slide groove and the small column moves along the front guiding groove the axial cam rotates 90-degrees.

2. The drawer interlock mechanism according to claim 1, wherein the slide groove of the fixation base having two convex points positioned in a declining angle, one of the two convex points is located on each of two sides of the slide groove.

3. The drawer interlock mechanism according to claim 1, wherein each of the two braking slides having two corresponding guiding grooves located on opposing sides thereof, each of the two corresponding guiding grooves having a locking point on a grooved surface thereof, the slide groove of the fixation base having two convex points, one of the two convex points is inserted into one of the two corresponding guiding grooves of each of the two braking slides, the locking point of each of the two corresponding guiding grooves selectively engaging and limiting an outward movement of one of the two convex points of one of the two braking slides.

4. The drawer interlock mechanism according to claim 1, wherein the guiding switch having a declining guiding surface located on the front guiding groove of the guiding slide groove.

5. The drawer interlock mechanism according to claim 1, wherein a path formed by the curved slide groove of the guiding switch provides the big column of the axial cam with a rotation of 90-degrees.

6. The drawer interlock mechanism according to claim 1, wherein the front guiding groove of the guiding slide groove of the guiding switch has a declining surface guiding the small column to rotate the axial cam and guiding the big column to enter the curved slide groove, the axial cam selectively rotating 90-degrees in the guiding switch.

* * * * *